US007902772B2

(12) United States Patent
Shin et al.

(10) Patent No.: US 7,902,772 B2
(45) Date of Patent: Mar. 8, 2011

(54) CIRCUIT AND METHOD FOR SENSING OPEN-CIRCUIT LAMP OF A BACKLIGHT UNIT AND DISPLAY DEVICE WITH CIRCUIT FOR SENSING OPEN-CIRCUIT LAMP OF BACKLIGHT UNIT

(75) Inventors: Hyun-Il Shin, Gyeongsangbuk-Do (KR); Jae Ho Lee, Daegu (KR); Chang-Ho Lee, Daegu (KR)

(73) Assignee: LG Display Co., Ltd., Seoul (KR)

( * ) Notice: Subject to any disclaimer, the term of this patent is extended or adjusted under 35 U.S.C. 154(b) by 303 days.

(21) Appl. No.: 11/898,312

(22) Filed: Sep. 11, 2007

(65) Prior Publication Data

US 2008/0001556 A1 Jan. 3, 2008

Related U.S. Application Data

(62) Division of application No. 11/169,783, filed on Jun. 30, 2005, now Pat. No. 7,298,096.

(30) Foreign Application Priority Data

Nov. 24, 2004 (KR) ..... 10-2004-0096762

(51) Int. Cl.
*G05F 1/00* (2006.01)

(52) U.S. Cl. ..... 315/307; 315/274; 315/224; 315/312; 315/247

(58) Field of Classification Search ..... 315/291, 315/297, 307–326, 224, 225, 247, 246
See application file for complete search history.

(56) References Cited

U.S. PATENT DOCUMENTS

| | | | | |
|---|---|---|---|---|
| 5,952,791 | A * | 9/1999 | Watanabe et al. | 315/225 |
| 6,184,631 | B1 * | 2/2001 | Noma et al. | 315/224 |
| 6,836,081 | B2 * | 12/2004 | Swanson et al. | 315/307 |
| 7,583,035 | B2 * | 9/2009 | Shteynberg et al. | 315/307 |
| 2002/0140380 | A1 * | 10/2002 | Biebl | 315/291 |
| 2004/0189216 | A1 * | 9/2004 | Choi | 315/291 |
| 2005/0127883 | A1 * | 6/2005 | Hoshino et al. | 323/274 |
| 2005/0156539 | A1 | 7/2005 | Ball | |
| 2006/0038513 | A1 | 2/2006 | Henry | |
| 2006/0087262 | A1 | 4/2006 | Kim et al. | |
| 2007/0024211 | A1 | 2/2007 | Rimmer et al. | |

FOREIGN PATENT DOCUMENTS

| | | |
|---|---|---|
| JP | 2000-116157 | 4/2000 |
| JP | 2004-265869 | 9/2004 |

* cited by examiner

*Primary Examiner* — Tuyet Thi Vo
(74) *Attorney, Agent, or Firm* — Birch, Stewart, Kolasch & Birch, LLP

(57) ABSTRACT

A circuit for sensing an open-circuit lamp is provided. The circuit includes a reference voltage output unit, a voltage sensor, and a comparator. The reference voltage output unit provides a reference voltage. The voltage sensor detects a sensed voltage corresponding to a status of a lamp. The status of the lamp includes an open-circuit status and a closed-circuit status. The comparator compares the sensed voltage with the reference voltage and outputs a result indicating the status of the lamp.

19 Claims, 9 Drawing Sheets

CIRCUIT AND METHOD FOR SENSING OPEN-CIRCUIT LAMP OF A BACKLIGHT UNIT AND DISPLAY DEVICE WITH CIRCUIT FOR SENSING OPEN-CIRCUIT LAMP OF BACKLIGHT UNIT

This application is a Divisional of application Ser. No. 11/169,783 filed on Jun. 30, 2005 now U.S. Pat. No. 7,298,096, and for which priority is claimed under 35 U.S.C. §120; and this application claims priority of Application No. 10-2004-0096762 filed in Korea on Nov. 24, 2004 under 35 U.S.C. §119; the entire contents of all are hereby incorporated by reference.

BACKGROUND OF THE INVENTION

1. Field of the Invention

The present invention relates to liquid crystal display (LCD) devices. More particularly, the present invention relates to a circuit and a method for sensing an open-circuit lamp of a backlight unit, and a display device with a circuit for sensing an open-circuit lamp of a backlight unit.

2. Discussion of the Related Art

Cathode ray tube (CRT) devices have been widely used as display devices such as televisions or monitors. However, the CRT devices have the drawbacks of heavy weight and big size.

To substitute the CRT devices, liquid crystal display (LCD) devices have been researched and developed. The LCD devices are advantageously light-weight, dimensionally compact, and have low power consumption during operation. Recently, the LCD devices have been widely used as display devices such as monitors for desktop computers, outdoor monitors of more than 30 inches, and hang-on-the-wall televisions as well as monitors for laptop computers.

Generally, LCD devices display images by controlling transmittance of external light source. Thus, the LCD devices need an external light source such as backlight units.

Backlight units are classified into an edge type and a direct type according to the position of a light source with respect to a display panel. In direct-type backlight units, a light source is disposed directly under a display panel. Since the direct-type backlight units can provide high luminance, the direct-type backlight units are widely used for large LCD devices of more than 30 inches.

A direct-type backlight unit uses a plurality of lamps as a light source. The lamp may include a cold cathode fluorescent lamp (CCFL) or an external electrode fluorescent lamp (EEFL). However, if one lamp is open-circuit, a higher voltage will be applied to the other lamps. Accordingly, this may decrease the lifespan of the lamps or affect the operation of the lamps.

To solve this problem, a circuit for sensing an open-circuit lamp may be added to an inverter. However, since the related art circuit shuts down the power only when a plurality of lamps are open-circuit, the problems of stability of the device still exist.

SUMMARY OF THE INVENTION

Accordingly, the present invention is directed to a circuit an a method for sensing an open-circuit lamp of a backlight unit, and a display device with a circuit for sensing an open-circuit lamp that substantially obviate one or more of the problems due to limitations and disadvantages of the related art.

An advantage of the present invention is to provide a circuit and a method for sensing an open-circuit of a backlight unit, and a display device with a circuit for sensing an open-circuit lamp that effectively protect the backlight unit and increase a lifespan of the backlight unit.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a circuit for sensing an open-circuit lamp includes an enable signal output unit outputting an enable signal, a reference voltage output unit outputting a reference voltage, a sensing voltage output unit outputting a sensed voltage for deciding whether the lamp is open-circuit, a voltage comparison unit comparing the sensed voltage with the reference voltage and then outputting a decision signal according to a result of comparing the sensed voltage with the reference voltage, and an enable signal control unit controlling an output of the enable signal according to the decision signal.

In another aspect, a display device includes a display panel, a panel driving circuit for driving the display panel, a lamp unit including at least one lamp and providing light the display panel, the at least one lamp having electrodes at both ends thereof, a circuit for sensing an open-circuit lamp and a system power control unit controlling power supply according an enable signal. The circuit for sensing the open-circuit lamp includes an enable signal output unit outputting an enable signal, a reference voltage output unit outputting a reference voltage, a sensing voltage output unit outputting a sensed voltage for deciding whether the lamp is open-circuit, a voltage comparison unit comparing the sensed voltage with the reference voltage and then outputting a decision signal according to a result of comparing the sensed voltage with the reference voltage, and an enable signal control unit controlling output of the enable signal according to the decision signal.

In another aspect, a method for sensing an open-circuit lamp using a circuit for sensing an open-circuit lamp, wherein the circuit for sensing an open-circuit lamp includes an enable signal output unit, a reference voltage output unit, a sensing voltage output unit, a voltage comparison unit, and an enable signal control unit, the method includes outputting an enable signal from the enable signal output unit, outputting a reference voltage from the reference voltage output unit, outputting a sensed voltage from the sensing voltage output unit, comparing the sensed voltage with the reference voltage in the voltage comparison unit and then outputting a decision signal, and controlling an output of the enable signal from the enable signal control unit according to the decision signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Lamps such as a cold cathode fluorescent lamp (CCFL), an external electrode fluorescent lamp (EEFL), or a flat lamp are used as a light source for a display device. The lamps have infinite impedance when a voltage is applied in an early stage, and then the lamps have impedance of several hundred ohms to several thousand ohms after the voltage is stably applied. However, when one electrode of the lamp is open-circuit, the open-circuit electrode has infinite impedance, and thus a voltage applied to the open-circuit electrode is increased sharply.

Accordingly, in the present invention, the infinite impedance of the open-circuit electrode is used for sensing an open-circuit lamp. That is, change of voltage at the open-circuit lamp electrode or change of an induced voltage at the open-circuit lamp electrode is measured and then the measured voltage is compared with a reference voltage to determine whether a lamp is open-circuit.

Figure 1:
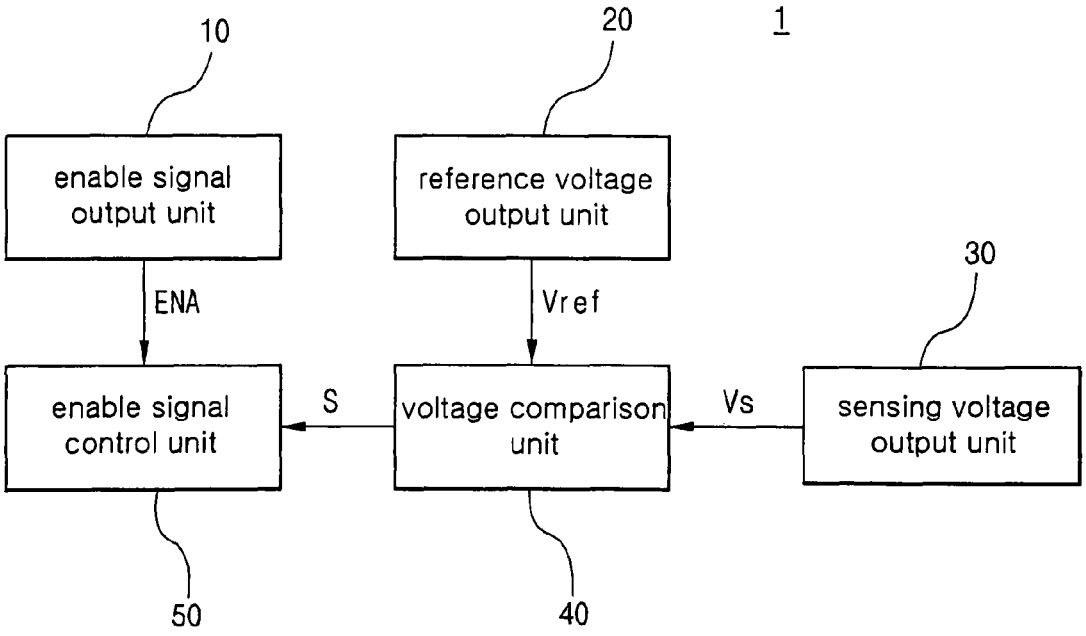
FIG. 1 is a block diagram illustrating a circuit for sensing an open-circuit lamp of a backlight unit according to an embodiment of the present invention.

FIG. 1 is a block diagram illustrating a circuit for sensing an open-circuit lamp of a backlight unit according to an embodiment of the present invention. In FIG. 1, a circuit 1 for sensing an open-circuit lamp in this embodiment includes an enable signal output unit 10, a reference voltage output unit 20, a sensing voltage output unit 30, a voltage comparison unit 40, and an enable signals control unit 50.

The enable signal output unit 10 outputs an enable signal ENA for enabling the operation of a backlight unit. The enable signal ENA may be also used to enable the operation of a liquid crystal panel. The enable signal ENA instructs a power source unit (not shown) to continuously apply a voltage to the backlight unit.

The reference voltage output unit 20 outputs a reference voltage Vref as a comparison standard to decide whether a lamp is open-circuit. The reference voltage Vref may be provided from an additional external circuit. For example, a voltage at a low voltage terminal of a secondary coil of a transformer in a lamp-driving inverter circuit may be used as the reference voltage Vref.

The sensing voltage output unit 30 senses whether electrodes of a lamp are open-circuit. The sensing voltage output unit 30 outputs a sensed voltage Vs to indicate whether the lamp is in a normal state (i.e., a closed-circuit state) or in an abnormal state (i.e., an open-circuit state). When the electrode of the lamp is open-circuit, a voltage or an electric field around the electrode is changed due to the infinite impedance of the electrode.

The voltage comparison unit 40, such as a comparator, receiving the sensed voltage Vs from the sensing voltage output unit 30 and the reference voltage Vref from the reference voltage output unit 20, compares the sensed voltage Vs with the reference voltage Vref. Thus, the voltage comparison unit 40 outputs a decision signal S when an increased voltage is detected due to an increase in impedance of an open-circuit lamp. In an embodiment, the voltage comparison unit 40 can be an operational amplifier (OP-AMP).

The enable signal control unit 50 receives the enable signal ENA from the enable signal output unit 10 and controls the output of the enable signal according to the decision signal S from the voltage comparison unit 40. In an embodiment, the enable signal control unit 50 may include a transistor. If the output of the enable signal is cut off due to the open-circuit lamp, the power supply stops providing power and the display device is shut down.

Figure 2:
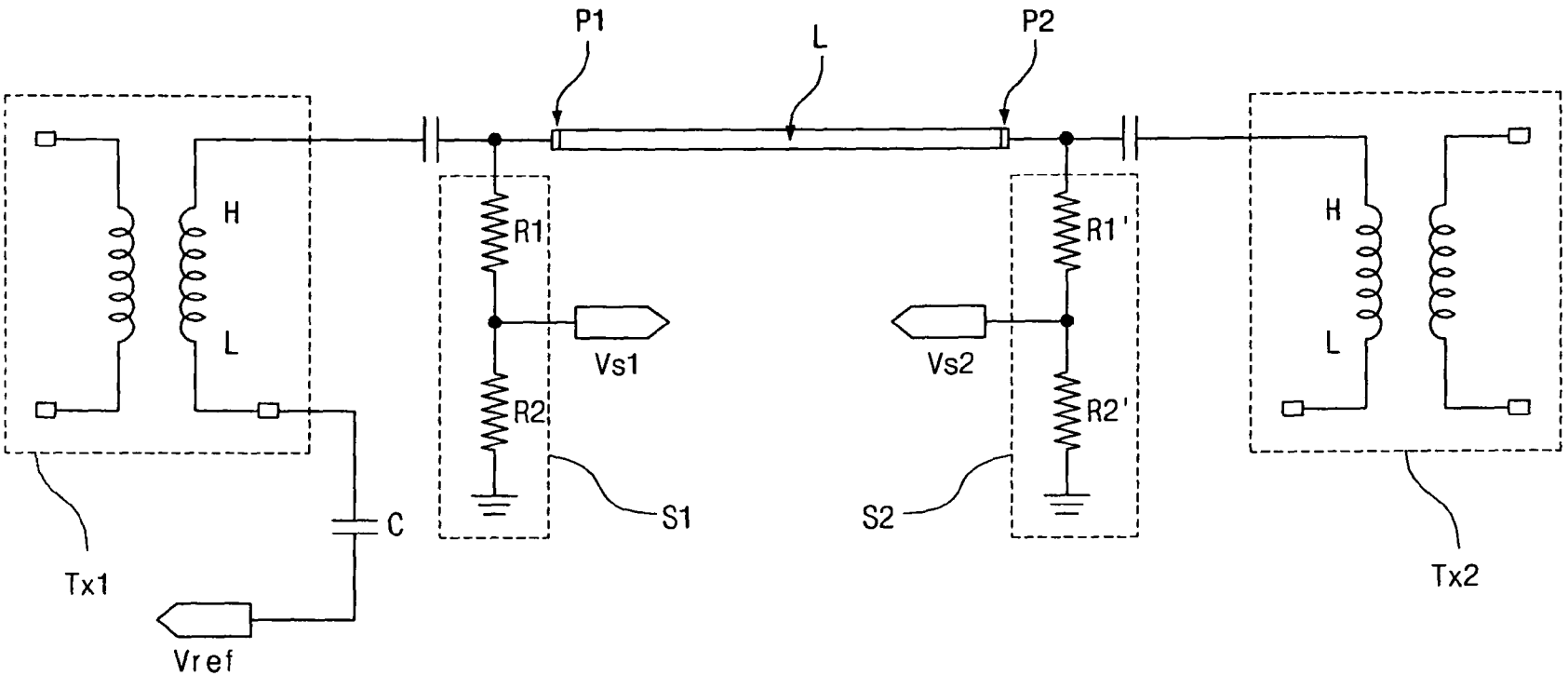
FIG. 2 is a circuit diagram illustrating a part of a circuit for sensing an open-circuit lamp of a backlight unit according to a first embodiment of the present invention.

FIG. 2 is a circuit diagram illustrating a part of a circuit for sensing an open-circuit lamp of a backlight unit according to a first embodiment of the present invention. In FIG. 2, voltage-dividing circuits S1 and S2 are connected to both electrodes P1 and P2 of a lamp L as the sensing voltage output unit 30 of FIG. 1. Each of the voltage-dividing circuits S1 and S2 includes division resistors R1 and R2 or R1' and R2' connected in series and outputs a sensed voltage Vs1 or Vs2.

A fluorescent lamp is driven by boosting an inputted power from about 220V AC (alternating current) voltage to about 1000 to 1500 V AC voltage through the transformers Tx2 and Tx2 which apply the boosted power to the electrodes P1 and P2 of the lamp L. In an embodiment, the division resistors R1 and R2 or R1' and R2' may be formed such that the sensed voltages divided by the voltage-dividing circuits S1 and S2 are about several volts (V). In addition, a low voltage L at a secondary coil of one transformer Tx1 may be used as the reference voltage Vref of the reference voltage output unit 20.

If one electrode P1 or P2 of the lamp L is open-circuit, a voltage at the electrode P1 or P2 is increased due to the infinite impedance of the electrode P1 or P2. Therefore, the sensed voltages Vs1 and Vs2 outputted from the voltage-dividing circuit S1 or S2 are also increased, and the open-circuit lamp is detected by comparing the sensed voltages Vs1 and Vs2 with the reference voltage Vref. As a result, appropriate measures such as cutting off voltages are carried out.

Figure 3:
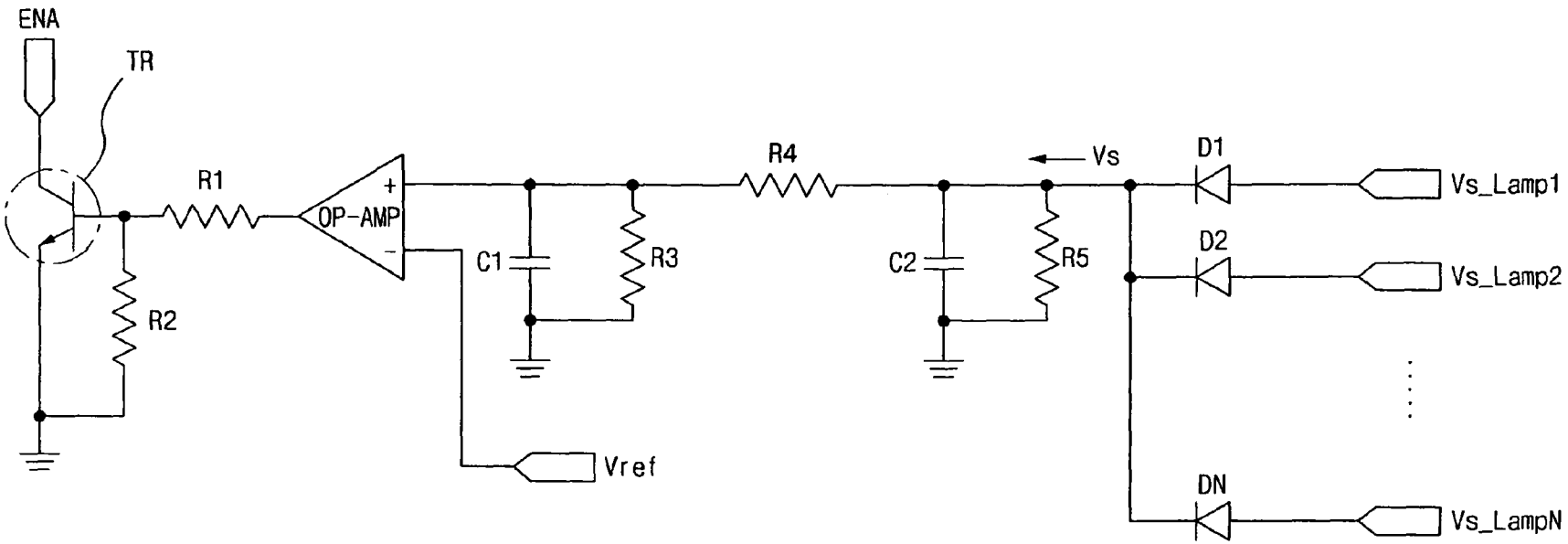
FIG. 3 is a circuit diagram illustrating a circuit for sensing an open-circuit lamp of a backlight unit including the structure of FIG. 2 according to the first embodiment of the present invention.

FIG. 3 is a circuit diagram illustrating a circuit for sensing an open-circuit lamp of a backlight unit including the structure of FIG. 2 according to the first embodiment of the present invention. In FIG. 3, the backlight unit includes a plurality of lamps. A plurality of sensing voltage output units are respectively connected to the lamps, and output sensed voltages Vs_Lamp1 to Vs_LampN (N is a natural number). The sensed voltages Vs_Lamp1 to Vs_LampN are inputted to an operational amplifier OP-AMP, which is a comparator and receives a reference voltage Vref as a comparison standard. If there is an increased voltage among the sensed voltages Vs_Lamp1 to Vs_LampN, the operational amplifier OP-AMP outputs a decision signal. Accordingly, a transistor TR, as an enable signal control unit in this embodiment, receives the decision signal and blocks the output of the enable signal.

The circuit for sending an open-circuit lamp may be used for a display device, which includes a display panel, a panel-driving circuit unit for driving the display panel, a lamp unit providing light to the display panel, a lamp-driving circuit unit for driving the lamp unit, and a system power control unit controlling power supply according to an enable signal. Here, if an open-circuit lamp is sensed, the power supply is cut off. Accordingly, the stability of the device is increased.

Figure 4A:
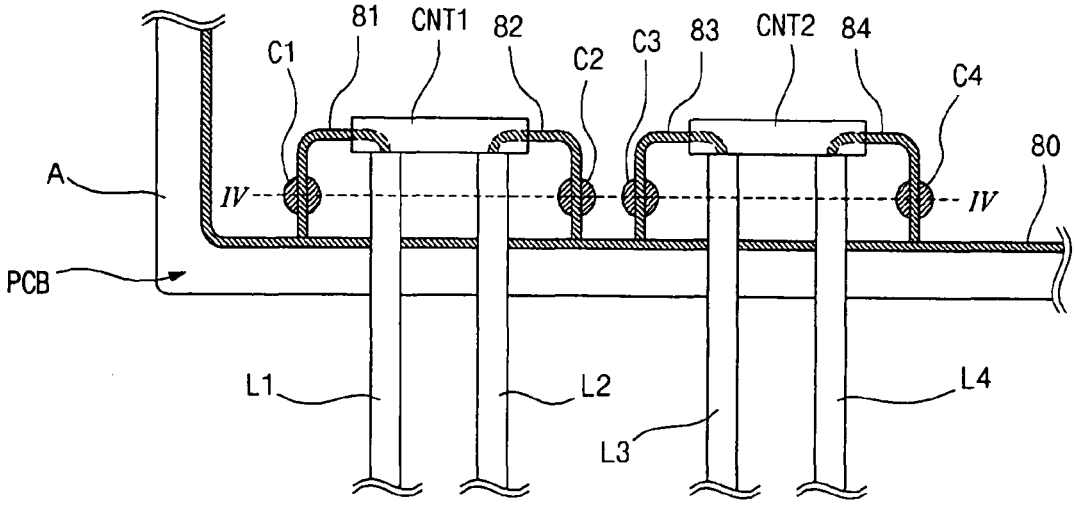
FIGS. 4A and 4B are views illustrating a sensing voltage output unit of a circuit for sensing an open-circuit lamp according to a second embodiment of the present invention.
Figure 4B:
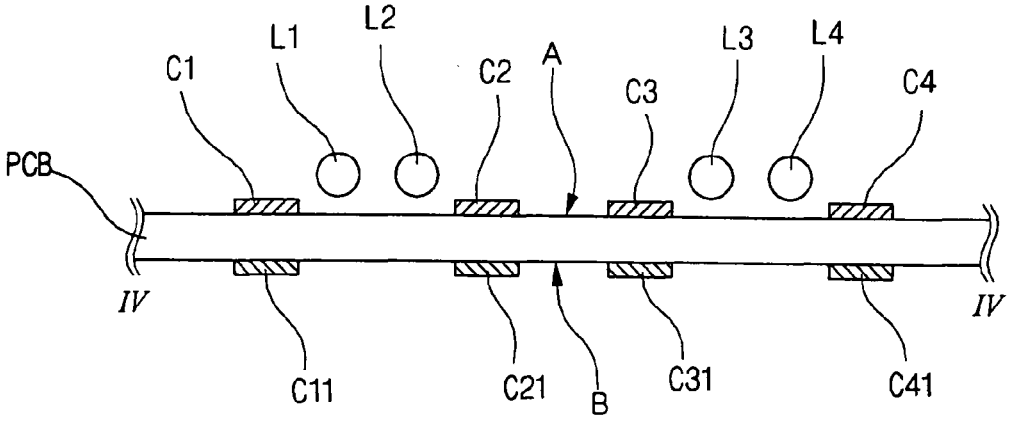

FIGS. 4A and 4B are views illustrating a sensing voltage output unit of a circuit for sending an open-circuit lamp according to a second embodiment of the present invention. FIG. 4A is a plan view of the sensing voltage output unit, and FIG. 4B is a cross-sectional view along the line IV-IV. In the second embodiment, the open-circuit lamp is detected by sensing the change of a voltage induced according to the change of a voltage inputted to an electrode of a lamp. That is, when one electrode of the lamp is open-circuit, the voltage at the electrode is increased due to the infinite impedance of the electrode. Thus, if a conductor is disposed in an electric field of a voltage supplying line for providing the voltage, a voltage is induced in the conductor, and the induced voltage is used as a sensed voltage Vs to determine whether the lamp is open-circuit.

As illustrated in FIG. 4A, a plurality of lamps L1, L2, L3 and L4 are connected to lamp connectors CNT1 and CNT2 that are formed on a first side A of a printed circuit board PCB. Lamp-driving voltage lines 81, 82, 83 and 84 extend from a main power line 80 and are connected to the lamp connectors CNT1 and CNT2. The lamp-driving voltage lines 81, 82, 83 and 84 provide lamp-driving voltages to the respective lamps L1, L2, L3 and L4. First patterns C1, C2, C3 and C4 of any shapes and sizes are formed on the lamp-driving voltage lines 81, 82, 83 and 84, respectively. The first patterns C1, C2, C3 and C4 are formed on the first side A of the printed circuit board PCB. The first patterns C1, C2, C3 and C4 are formed of a conductive material, and the first patterns C1, C2, C3 and C4 receive the lamp-driving voltages from the lamp-driving voltage line 81, 82, 83 and 84.

Referring to FIG. 4B, second patterns C11, C21, C31 and C41 are formed on a second side B of the printed circuit board PCB opposite to the first side A. The second patterns C11, C21, C31 and C41 correspond to the first patterns C1, C2, C3 and C4, respectively. The second patterns C11, C21, C31 and C41 are also formed of a conductive material.

Induced voltages are induced by the second patterns C11, C21, C31 and C41 due to the lamp-driving voltages applied to the first patterns C1, C2, C3 and C4. The induced voltages of the second patterns C11, C21, C31 and C41 are used as the sensed voltages Vs. Then, the induced voltages, as the sensed voltages Vs, are compared with the reference voltage Vref through the voltage comparison unit 40 of FIG. 1. If the lamp is determined as an open-circuit lamp as a result of the comparison, the enable signal control unit 50 of FIG. 1 will block the output of the enable signal to protect the system.

Figure 5A:
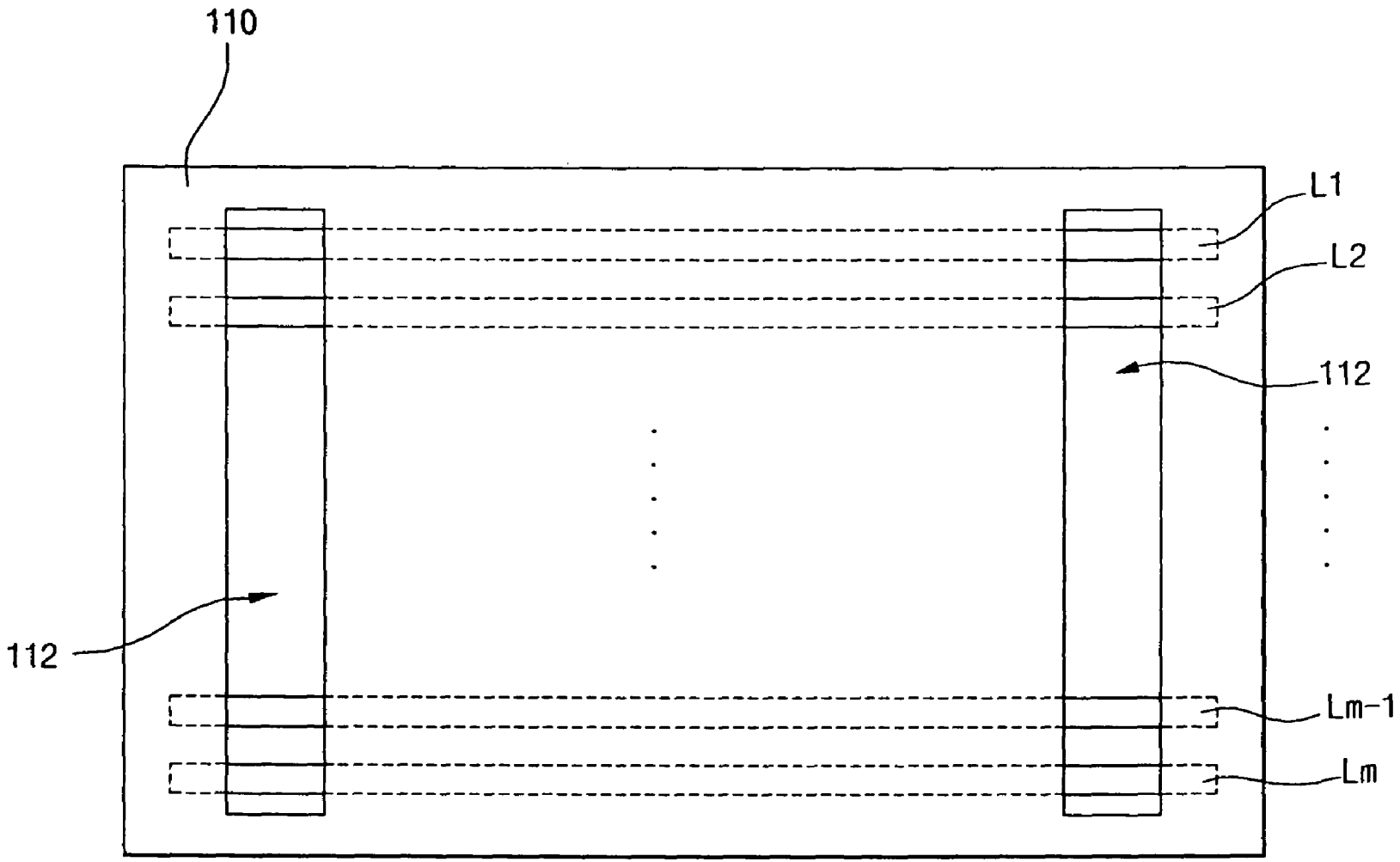
FIGS. 5A and 5B are views illustrating a sensing voltage output unit of a circuit for sensing an open-circuit lamp according to a third embodiment of the present invention.
Figure 5B:
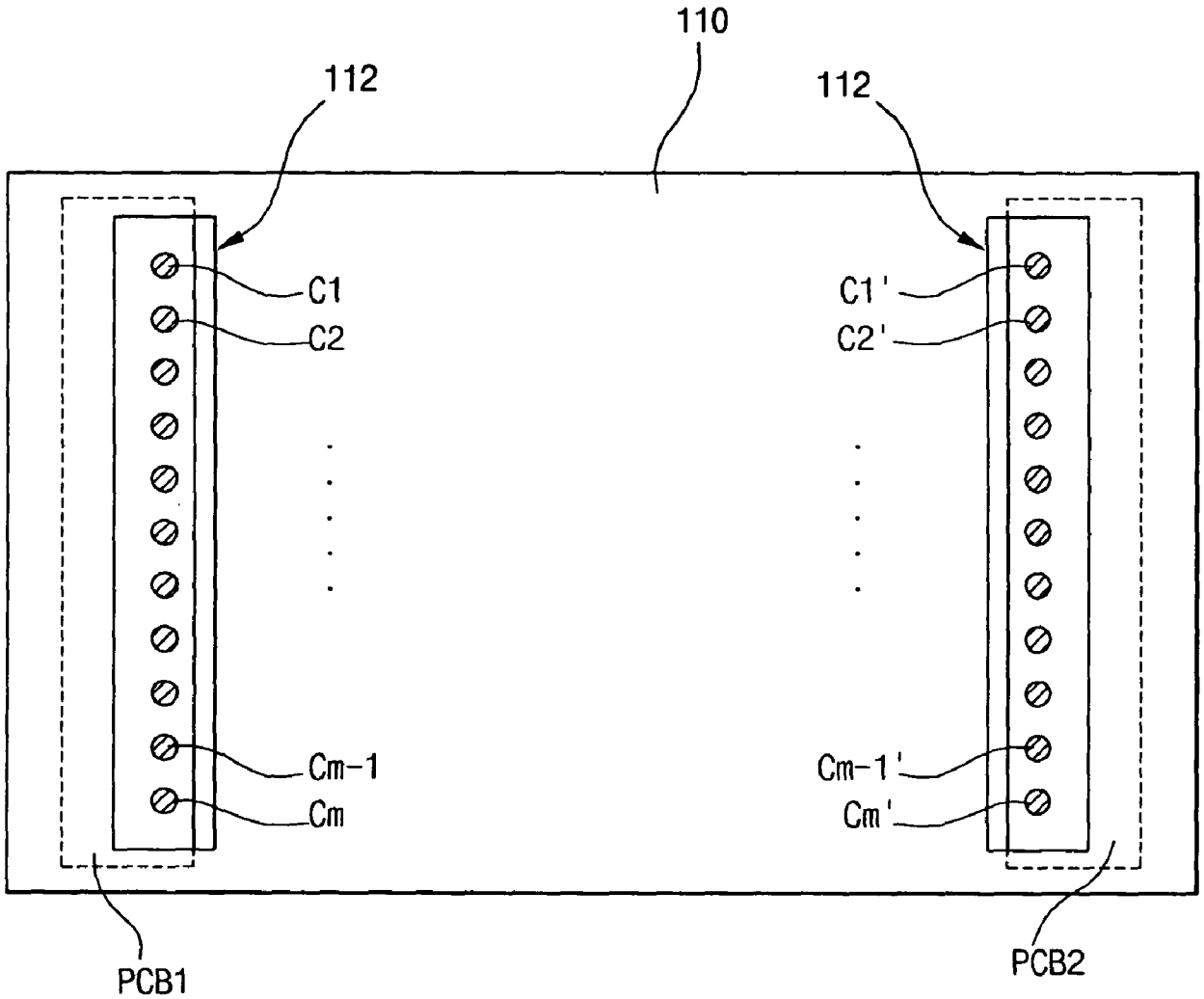

FIGS. 5A and 5B illustrate a sensing voltage output unit of a circuit for sensing an open-circuit lamp according to a third embodiment of the present invention. FIG. 5A is a bottom view of the sensing voltage output unit, and FIG. 5B is a plan view of the sensing voltage output unit. In the third embodiment, a conductive pattern is disposed in an electric field of a lamp, and an induced voltage induced due to the conductive pattern is used as the sensed voltage. When the lamp is open-circuit, a higher induced voltage, which is proportional to a higher voltage at an electrode of the lamp due to the infinite impedance, is induced by the conductive pattern. Thus, the open-circuit lamp is sensed by an increase in the inducted voltage.

As illustrated in FIGS. 5A and 5B, printed circuit boards PCB1 and PCB2 are disposed on an outer surface of a cover bottom 110, of which a plurality of lamps L1, L2, . . . , Lm−1, and Lm are disposed on an inner surface. The printed circuit boards PCB1 and PCB2 are disposed at both ends of the lamps L1, L2, . . . , Lm−1, and Lm. A plurality of conductive patterns C1, C2, . . . , Cm−1, and Cm or C1', C2', . . . , Cm−1', and Cm' are formed on each of the printed circuit boards PCB1 and PCB2. The conductive patterns C1, C2, . . . , Cm−1, and Cm or C1', C2', . . . , Cm−1', and Cm' correspond to the respective lamps L1, L2, . . . , Lm−1, and Lm.

The cover bottom 110 includes at least one sensing hole 112 in order to increase an induced voltage induced by the conductive patterns C1, C2, . . . , Cm−1, and Cm or C1', C2', . . . , Cm−1', and Cm' at a bottom side thereof. In an embodiment, the sensing hole 112 is disposed at each side of the lamps L1, L2, . . . , Lm−1, and Lm and is adjacent to an electrode at each side of the lamps L1, L2, . . . , Lm−1, and Lm. As illustrated in FIG. 5A, the lamps L1, L2, . . . , Lm−1, and Lm have a minimum distance from the conductive patterns C1, C2, . . . , Cm−1, and Cm or C1', C2', . . . , Cm−1', and Cm' through the sensing hole 112. The sensing hole 112 extends along a direction crossing the lamps L1, L2, Lm−1, and Lm.

Figure 6:
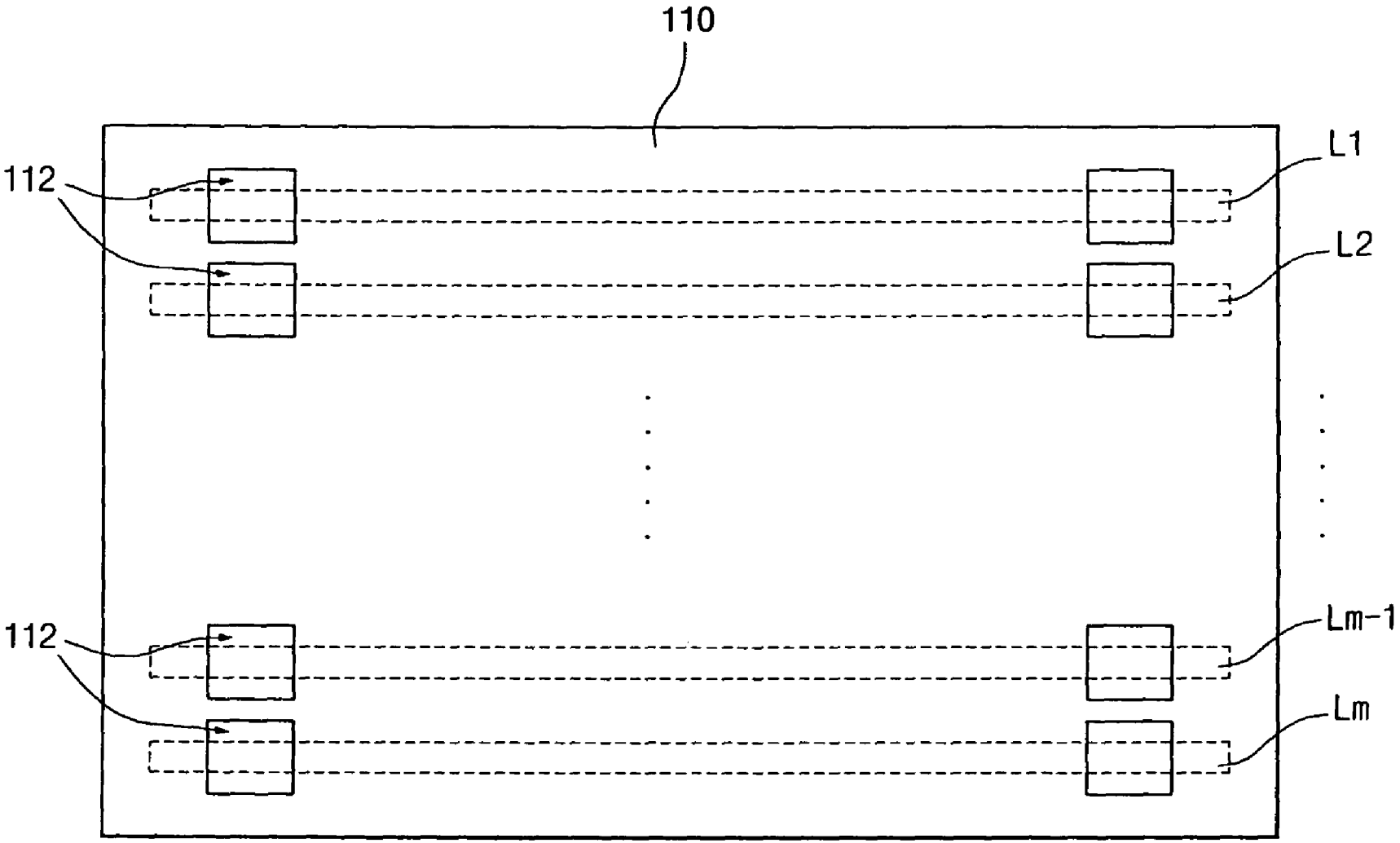
FIG. 6 is a bottom view illustrating another sensing voltage output unit of a circuit for sensing an open-circuit lamp according to the third embodiment of the present invention.

FIG. 6 is a bottom view illustrating another sensing voltage output unit of a circuit for sensing an open-circuit lamp according to the third embodiment of the present invention. As illustrated in FIG. 6, a plurality of sensing holes 112 are formed only in the respective regions corresponding to the lamps L1, L2, . . . , Lm−1, and Lm and the conductive patterns C1, C2, . . . , Cm−1, and Cm or C1', C2', . . . , Cm−1', and Cm'.

In the third embodiment, the cover bottom 110 and the conductive patterns C1, C2, . . . , Cm−1, and Cm or Cm', C2', . . . , Cm−1', and Cm' are used as the sensing voltage output unit 30 of FIG. 1. When one electrode of a lamp is open-circuit, a voltage at the electrode is increased due to the infinite impedance, and an induced voltage is induced from an electric field around the lamp. The induced voltage is changed along with the change of the electric field. Thus, the induced voltage is used as the sensed voltage Vs. A plurality of sensed voltage Vs are compared with the reference voltage Vref through the voltage comparison unit 40 of FIG. 1. If the lamp is determined as an open-circuit lamp as a result of the comparison, the enable signal control unit 50 of FIG. 1 will block the output of the enable signal to protect the system.

Figure 7:
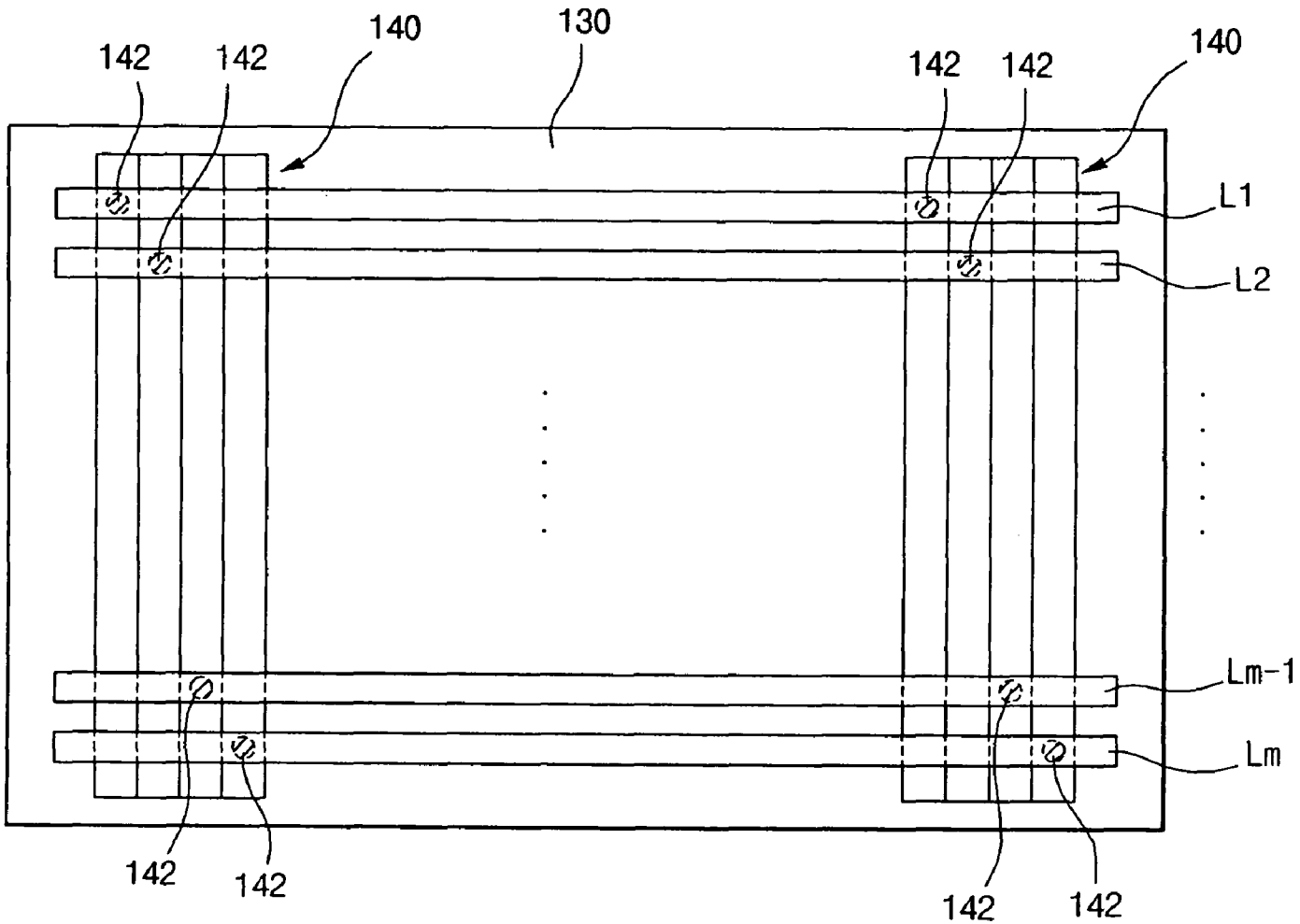
FIG. 7 is a plan view illustrating a sensing voltage output unit of a circuit for sensing an open-circuit lamp according to a fourth embodiment of the present invention.

FIG. 7 is a plan view illustrating a sensing voltage output unit of a lamp open sensing circuit according to a fourth embodiment of the present invention. In the fourth embodiment, the change of the induced voltage is detected through a cable including at least one conductive line to determine whether the lamp is open-circuit. In FIG. 7, at least one lamp L1, L2, . . . , Lm−1, or Lm is disposed on a cover bottom 130*a*, and a sensing cable 140 is disposed between the cover bottom 130 and the at least one lamp L1, L2, . . . , Lm−1, or Lm. The sensing cable 140 senses the induced voltage as the sensed voltage. The sensing cable 140 may be one of a flexible printed circuit (FPC) and a flexible flat cable (FFC).

The sensing cable 140 extends along a direction crossing the at least one lamp L1, L2, . . . , Lm−1, or Lm. The sensing cable 140 includes at least one conductive line, which includes a metallic core and an insulator surrounding the metallic core. The insulator is removed at a region facing the at least one lamp L1, L2, . . . , Lm−1, or Lm by a minimum distance from the at least one lamp L1, L2, . . . , Lm−1, or Lm to form an exposed portion 142 exposing the metallic core. In this embodiment, only one exposed portion 142 is formed in each conductive line. The exposed portion 142 functions as same as the patterns of the third embodiment. In this embodiment, the exposed portion 142 is disposed directly under the at least one lamp L1, L2, . . . , Lm−1, or Lm.

Desirably, to detect the open-circuit lamp at both sides of the at least one lamp L1, L2, . . . , Lm−1, or Lm, the sensing cable 140 is disposed at both sides of the at least one lamp L1, L2, . . . , Lm−1, or Lm. The sensing cable 140 is adjacent to an electrode at each side of the at least one lamp L1, L2, . . . , Lm−1, or Lm.

Figure 8:
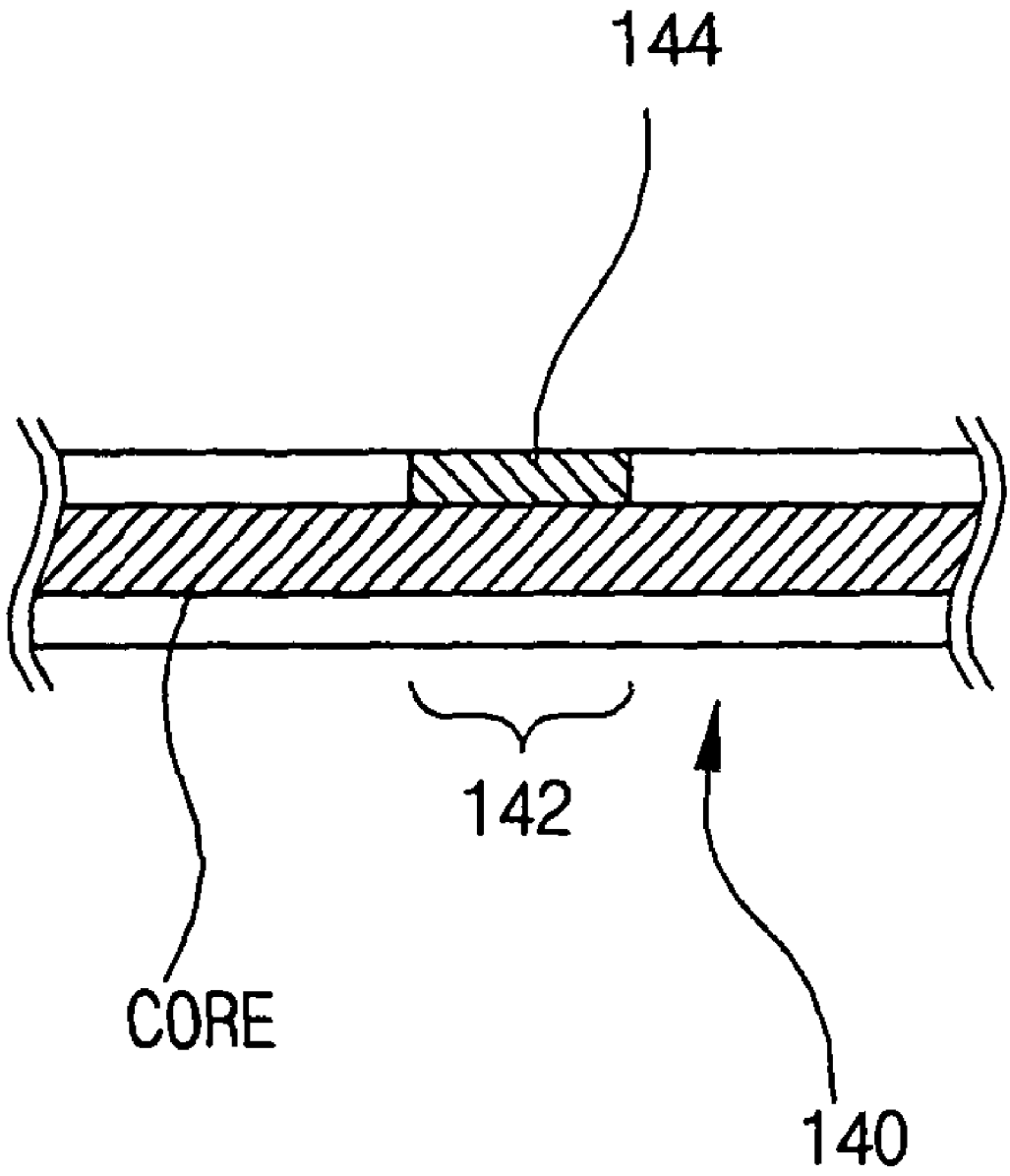
FIG. 8 is a cross-sectional view illustrating the sensing cable according to an embodiment of the present invention.

FIG. 8 is a cross-sectional view illustrating the sensing cable according an embodiment of the present invention. In FIG. 8, the sensing cable 140 further includes a conductive cover 144 on the exposed metallic core of the exposed portion 142 so that an induction effect of the induced voltage is increased.

In the fourth embodiment, a sensed voltage Vs is outputted from the sensing cable 140 due to the induced voltage at each exposed portion 142 and is compared with the reference voltage Vref through the voltage comparison unit 40 of FIG. 1. If the lamp is determined as an open-circuit lamp as a result of the comparison, the enable signal control unit 50 of FIG. 1 will block the output of the enable signal to protect the system.

In an embodiment of the present invention, lamps may be sensed individually, and appropriate measures can be carried out. Accordingly, the system is effectively protected and a lifespan of the system is increased.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A circuit for driving a lamp, comprising:

a reference voltage output unit, the reference voltage output unit providing a reference voltage;

a voltage sensor, the voltage sensor detecting a sensed voltage corresponding to a status of a lamp, the status of the lamp including an open-circuit status and a closed-circuit status;

a comparator, the comparator comparing the sensed voltage with the reference voltage and outputting a result indicating the status of the lamp;

an enable signal output unit for outputting an enable signal; and an enable signal control unit, the enable signal control unit receiving the result indicating the status of the lamp, the enable signal control unit disabling the enable signal output unit when the result indicates the status of the lamp being the open-circuit status, wherein the voltage sensor includes first and second voltage-dividing circuits connected to both electrodes of the lamp, respectively, and the sensed voltage includes first and second sensed voltages output from the first and second voltage-dividing circuits, respectively, and wherein the first and second sensed voltages are compared with the reference voltage to thereby detect the lamp being open-circuit.

2. The circuit of claim 1, wherein the enable signal control unit includes a transistor.

3. The circuit of claim 1, wherein the voltage divider includes first and second resistors connected in series between the electrode of the lamp and the ground.

4. The circuit of claim 1, wherein the comparator includes an operational amplifier (OP-AMP).

5. The circuit of claim 1, wherein the lamp is one of a cold cathode fluorescent lamp (CCFL), an external electrode fluorescent lamp (EEFL), and a flat lamp.

6. The circuit of claim 1, wherein a voltage is supplied to an electrode of the lamp, the voltage sensor including a first conductor and a second conductor, the first conductor receiving the voltage supplied to the electrode of the lamp, the second conductor facing the first conductor with a gap and acquiring an induced voltage at the second conductor, the induced voltage being the sensed voltage.

7. The circuit of claim 6, wherein the first conductor is on a first side of a printed circuit board and the second conductor is on a second side of the printed circuit board.

8. The circuit of claim 1, wherein a voltage is supplied to an electrode of the lamp, the voltage sensor including a conductor adjacent to the electrode of the lamp and having a gap with the lamp, the conductor acquiring an induced voltage from an electric field around the lamp.

9. The circuit of claim 8, wherein the conductor is on a printed circuit board, which is disposed at a bottom side of a cover bottom, the cover bottom including a sensing hole that extends along a direction crossing the lamp.

10. The circuit of claim 9, wherein the conductor corresponds to the sensing hole.

11. The circuit of claim 8, wherein the conductor includes a cable, the cable including a metallic core and an insulating surrounding the metallic core, a portion of the metallic core being exposed at a region adjacent to the electrode of the lamp.

12. The circuit of claim 11, wherein the cable extends along a direction crossing the lamp.

13. The circuit of claim 11, wherein the conductor further includes a conductive cover covering the exposed portion of the metallic core.

14. The circuit of claim 11, wherein the cable includes only one exposed portion of the metallic core.

15. The circuit of claim 11, wherein the cable is one of a flexible printed circuit (FPC) and a flexible flat cable (FFC).

16. A method for driving a lamp, the method comprising:

providing a reference voltage;

detecting a sensed voltage corresponding to a status of a lamp, the status of the lamp including an open-circuit status and a closed-circuit status;

comparing the sensed voltage with the reference voltage and outputting a result indicating the status of the lamp;

receiving the result indicating the status of the lamp; and disabling an enable signal control unit when the result indicates the status of the lamp being the open-circuit status;

wherein detecting a sensed voltage includes connecting first and second voltage-dividing circuits to both electrodes of the lamp, respectively, and detecting first and second sensed voltages output from the first and second voltage-dividing circuits, respectively, and wherein comparing the sensed voltage with the reference voltage and outputting a result indicating the status of the lamp includes comparing the first and second sensed voltages with the reference voltage to thereby detect the lamp being open-circuit.

17. The method of claim 16, wherein the step of detecting the sensed voltage corresponding to the status of the lamp includes:

providing a first conductor, the first conductor receiving a voltage supplied to an electrode of the lamp;

providing a second conductor facing the first conductor with a gap; and acquiring an induced voltage at the second conductor, the induced voltage being the sensed voltage.

18. The method of claim 16, wherein the step of detecting the sensed voltage corresponding to the status of the lamp includes:

providing a conductor adjacent to an electrode of the lamp and having a gap with the lamp; and acquiring an induced voltage by the conductor from an electric field around the lamp.

19. The method of claim 18, wherein providing the conductor includes:

providing a cable, the cable including a metallic core and an insulating surrounding the metallic core; and exposing a portion of the metallic core at a region adjacent to the electrode of the lamp.

* * * * *